US010493751B2

(12) United States Patent
Yamada et al.

(10) Patent No.: US 10,493,751 B2
(45) Date of Patent: Dec. 3, 2019

(54) LIQUID DISCHARGING APPARATUS

(71) Applicant: SEIKO EPSON CORPORATION, Tokyo (JP)

(72) Inventors: Tomonori Yamada, Nagano (JP); Koji Kurioka, Nagano (JP); Kazuhiro Nishiwake, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/840,080

(22) Filed: Dec. 13, 2017

(65) Prior Publication Data

US 2018/0170039 A1 Jun. 21, 2018

(30) Foreign Application Priority Data

Dec. 21, 2016 (JP) ..... 2016-248101

(51) Int. Cl.
*B41J 2/14* (2006.01)
*B41J 2/045* (2006.01)

(52) U.S. Cl.
CPC ..... *B41J 2/04541* (2013.01); *B41J 2/04581* (2013.01); *B41J 2/14201* (2013.01); *B41J 2002/14491* (2013.01)

(58) Field of Classification Search
None
See application file for complete search history.

(56) References Cited

U.S. PATENT DOCUMENTS

2015/0062220 A1* 3/2015 Kashimura ..... B41J 2/04541 347/10
2016/0339690 A1 11/2016 Matsumoto

FOREIGN PATENT DOCUMENTS

CN 202487561 U 10/2012
JP 2010-221500 A 10/2010
JP 2014216595 A * 11/2014

OTHER PUBLICATIONS

The Extended European Search Report for the corresponding European Patent Application No. 17207101.1 dated May 11, 2018.

* cited by examiner

*Primary Examiner* — Matthew Luu
*Assistant Examiner* — Tracey M McMillion
(74) *Attorney, Agent, or Firm* — Global IP Counselors, LLP

(57) ABSTRACT

A liquid discharging apparatus includes a head unit driven by a drive signal to discharge a liquid; a substrate; and a first transistor and a second transistor provided on the substrate and configured to generate the drive signal. In the substrate, a screw hole is provided between the first transistor and the second transistor.

8 Claims, 9 Drawing Sheets

| Sd[m] | Sd[m] DESIGNATED SETTING | SL[m] | |
|---|---|---|---|
| | | Tu1 | Tu2 |
| (1, 1) | LARGER DOT | H | H |
| (1, 0) | MIDDLE DOT | H | L |
| (0, 1) | SMALLER DOT | L | H |
| (0, 0) | NO RECORD | L | L |

LIQUID DISCHARGING APPARATUS

This application claims priority to Japanese Patent Application No. 2016-248101 filed on Dec. 21, 2016. The entire disclosure of Japanese Patent Application No. 2016-248101 is hereby incorporated herein by reference.

BACKGROUND

1. Technical Field

The present invention relates to a liquid discharging apparatus.

2. Related Art

A liquid discharging apparatus such as an ink jet printer forms an image on a recording medium by driving a discharging unit provided on a head unit and discharging, from nozzles of the discharging unit, a liquid such as ink that has been filled into a cavity of the discharging unit. Such a liquid discharging apparatus is provided with a drive signal generation circuit that generates a drive signal used for driving the discharging unit (see, for example, JP-A-2010-221500).

SUMMARY

A drive signal used for driving a discharging unit is a signal having a large amplitude, and a drive signal generation circuit generates heat when generating the drive signal. Thus, when the drive signal generation circuit generates a drive signal, the temperature of the drive signal generation circuit may rise. A rise in the temperature of the drive signal generation circuit may cause inaccurate operation of the drive signal generation circuit, which may result in degradation of image quality of an image formed by a liquid discharging apparatus and further cause a malfunction such as a failure of the drive signal generation circuit.

An advantage of some aspects of the invention is to provide a technique that reduces the likelihood of degradation of the image quality or the occurrence of a malfunction such as a failure of a drive signal generation circuit due to a rise in the temperature of the drive signal generation circuit.

A liquid discharging apparatus according to one aspect of the invention includes: a head unit driven by a drive signal to discharge a liquid; a substrate; and a first transistor and a second transistor provided on the substrate and configured to generate the drive signal. In the substrate, a screw hole is provided between the first transistor and the second transistor.

In general, in a drive signal generation circuit that generates a drive signal, the temperature of a pair of transistors (the first transistor and the second transistor) for generating the drive signal is likely to be higher than other components of the drive signal generation circuit. According to the invention, since a screw hole is provided between the pair of transistors, heat generated by the pair of transistors can be dissipated from the screw hole. Therefore, compared to a case where no screw hole is provided between the pair of transistors, the invention can suppress the temperature of the drive signal generation circuit to a low temperature and thus reduce the likelihood of occurrence of a malfunction due to a rise in the temperature of the drive signal generation circuit.

In the liquid discharging apparatus described above, a first pad electrically connected to an emitter of the first transistor, a second pad electrically connected to a base of the first transistor, and a third pad electrically connected to a collector of the first transistor may be provided on the substrate, and it is preferable that the distance between the screw hole and the first pad be longer than the distance between the screw hole and the third pad, and the distance between the screw hole and the second pad be longer than the distance between the screw hole and the third pad.

In general, in a transistor, heat generation is greater at the collector than at the emitter and the base. To address this, according to the above embodiment, since the screw hole is provided near the third pad electrically connected to the collector of the first transistor, the heat generated in the first transistor can be effectively dissipated.

The liquid discharging apparatus described above may further include a waveform designation circuit provided on the substrate and configured to generate a waveform designation signal designating a waveform of the drive signal. The first transistor and the second transistor may generate the drive signal having a waveform designated by the waveform designation signal, and it is preferable that the distance between the screw hole and the waveform designation circuit be longer than the distance between the screw hole and the third pad.

According to the above embodiment, since the screw hole is provided to a position closer to the third pad than to the waveform designation circuit, the heat generated in the first transistor can be effectively dissipated compared to a case where a screw hole is provided to a position closer to the waveform designation circuit than to the third pad.

In the liquid discharging apparatus described above, it is preferable that the diameter of the screw hole be larger than the distance between the screw hole and the third pad.

According to the above embodiment, since the diameter of the screw hole is larger than the distance between the screw hole and the third pad, the heat generated in the first transistor can be effectively dissipated compared to a case where the diameter of the screw hole is smaller than the distance between the screw hole and the third pad.

In the liquid discharging apparatus described above, a fourth pad electrically connected to an emitter of the second transistor, a fifth pad electrically connected to a base of the second transistor, and a sixth pad electrically connected to a collector of the second transistor may be provided on the substrate, and it is preferable that the distance between the screw hole and the fourth pad be longer than the distance between the screw hole and the sixth pad, and the distance between the screw hole and the fifth pad be longer than the distance between the screw hole and the sixth pad.

According to the above embodiment, since the screw hole is provided near the sixth pad electrically connected to the collector of the second transistor, the heat generated in the second transistor can be effectively dissipated.

The liquid discharging apparatus described above may further include a waveform designation circuit provided on the substrate and configured to generate a waveform designation signal designating a waveform of the drive signal. The first transistor and the second transistor may generate the drive signal having a waveform designated by the waveform designation signal, and it is preferable that the distance between the screw hole and the waveform designation circuit be longer than the distance between the screw hole and the sixth pad.

According to the above embodiment, since the screw hole is provided to a position closer to the sixth pad than to the waveform designation circuit, the heat generated in the second transistor can be effectively dissipated compared to a case when a screw hole is provided to a position closer to the waveform designation circuit than to the sixth pad.

In the liquid discharging apparatus described above, it is preferable that the diameter of the screw hole be larger than the distance between the screw hole and the sixth pad.

According to the above embodiment, since the diameter of the screw hole is larger than the distance between the screw hole and the sixth pad, the heat generated in the second transistor can be effectively dissipated compared to a case where the diameter of the screw hole is smaller than the distance between the screw hole and the sixth pad.

In the liquid discharging apparatus described above, the substrate may be fixed to a frame of the liquid discharging apparatus by a screw inserted in the screw hole.

According to the above embodiment, since the heat generated by the pair of transistors is dissipated to the frame via the screw inserted in the screw hole, the heat generated by the pair of transistors can be effectively dissipated.

Further, a liquid discharging apparatus according to another aspect of the invention includes a unit head driven by a drive signal to discharge a liquid; a substrate; and a first transistor and a second transistor provided on the substrate and configured to generate the drive signal. In the substrate, a plurality of screw holes are provided between the first transistor and the second transistor.

According to the above aspect, since a plurality of screw holes are provided between the pair of transistors, the heat generated by the pair of transistors can be dissipated from the plurality of screw holes.

BRIEF DESCRIPTION OF THE DRAWINGS

The invention will be described with reference to the accompanying drawings, wherein like numbers reference like elements.

DESCRIPTION OF EXEMPLARY EMBODIMENT

An embodiment of the invention will be described below with reference to the drawings. In each drawing, the size and the scale of respective portions may differ appropriately from those in the actual implementation. Further, while the embodiment described below is a preferred example of the invention and thus various technically preferable limitations are provided, in the following description, the scope of the invention is not limited to the embodiment unless described as limiting the invention in particular.

A. Embodiment

In the present embodiment, a liquid discharging apparatus will be described by illustrating an ink jet printer as an example that discharges ink (an example of a liquid) onto a recording sheet P (an example of a medium) to form an image.

1. Ink Jet Printer

The configuration of an ink jet printer 1 according to the present embodiment will be described below with reference to FIG. 1 and FIG. 2.

Figure 1:
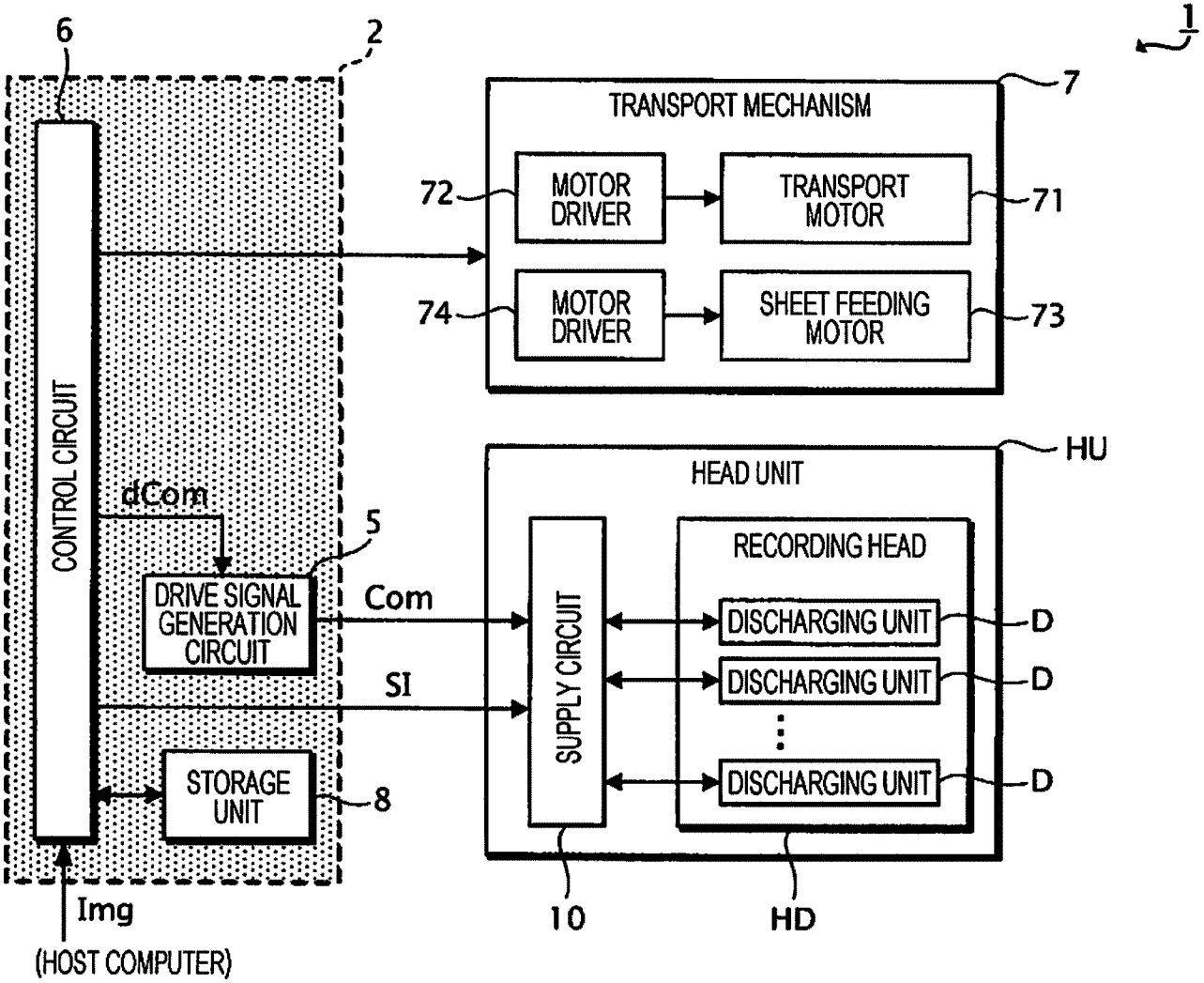
FIG. 1 is a block diagram illustrating an example configuration of an ink jet printer according to the invention.

FIG. 1 is a function block diagram illustrating an example configuration of the ink jet printer 1. Print data Img that represents an image to be formed by the ink jet printer 1 is supplied to the ink jet printer 1 from a host computer (not shown) such as a personal computer, a digital camera, or the like. The ink jet printer 1 performs a printing process for forming, on the recording sheet P, an image represented by the print data Img supplied from the host computer.

As illustrated in FIG. 1 as an example, the ink jet printer 1 includes a control module 2, a head unit HU on which discharging units D adapted to discharge ink are provided, and a transport mechanism 7 that changes a relative position of the recording sheet P with respect to the head unit HU. The control module 2 includes a control unit 6 that controls operation of each unit of the ink jet printer 1, a drive signal generation circuit 5 that generates a drive signal Com used for driving the discharging unit D, and a storage unit 8 that stores various information. Note that in the present embodiment a case in which the components of the control module 2 (the control unit 6, the drive signal generation unit 5, and the storage unit 8) are formed on a substrate 200 (see FIG. 6) is considered to be an example.

The head unit HU includes a recording head HD having M discharging units D and a supply circuit 10 that determines whether or not to supply, to the recording head HD, the drive signal Com output by the drive signal generation circuit 5 (in the present embodiment, M is an integer satisfying $1 \leq M$).

In the following description, in order to distinguish M discharging units D provided on the recording head HD from each other, M discharging units D may be denoted as the first discharging unit, the second discharging unit, . . . , and the M-th discharging unit. Further, an m-th discharging unit D may be called a discharging unit D(m) (variable m is an integer satisfying $1 \leq m \leq M$). Further, when a component, a signal, or the like of the ink jet printer 1 corresponds to the discharging unit D(m), a reference symbol denoting the component, the signal, or the like is appended with (m).

Further, in the following description, of the drive signals Com, a drive signal Com which is supplied to the discharging unit D may be referred to as a supply drive signal Vin. Further, the supply drive signal Vin supplied to the discharging unit D(m) may be referred to as the supply drive signal Vin(m).

The storage unit 8 includes both of a volatile memory such as a random access memory (RAM) and a nonvolatile memory such as read-only memory (ROM), electrically erasable programmable read-only memory (EEPROM), programmable ROM (PROM), or the like and stores various information such as the print data Img supplied from a host computer, a control program of the ink jet printer 1, and the like.

The control unit 6 includes a central processing unit (CPU). However, the control unit 6 may include a programmable logic device such as a field-programmable gate array instead of the CPU or in addition to the CPU.

The control unit 6 controls operation of respective units of the ink jet printer 1 by causing the CPU provided in the control unit 6 to execute a control program stored in the storage unit 8 and by operating according to the control program. Specifically, the control unit 6 generates signals for controlling operation of respective units in the ink jet printer 1, such as a print signal SI for controlling the supply circuit 10 provided in the head unit HU, a waveform designation signal dCom for controlling the drive signal generation circuit 5, a signal for controlling the transport mechanism 7, and the like.

Here, the waveform designation signal dCom is a digital signal that designates a waveform of the drive signal Com. That is, the control unit 6 is an example of a waveform designation circuit that generates the waveform designation signal dCom that designates a waveform of the drive signal Com.

Further, the drive signal Com is an analog signal for driving the discharging unit D. The drive signal generation circuit 5 generates the drive signal Com having a waveform defined by the digital waveform designation signal dCom.

Further, the print signal SI is a digital signal for designating a type of operation of the discharging unit D. Specifically, the print signal SI designates whether or not to supply the drive signal Com to the discharging unit D and thereby designate a type of operation of the discharging unit D. The designation of a type of operation of the discharging unit D is designation of whether or not to drive the discharging unit D, whether or not to discharge ink from the discharging unit D when driving the discharging unit D, or an amount of ink to be discharged from the discharging unit D when driving the discharging unit D.

When a print process is performed, the control unit 6 first stores in the storage unit 8 the print data Img supplied from a host computer. Next, in accordance with various data such as the print data Img stored in the storage unit 8, the control unit 6 generates various control signals such as the print signal SI, the waveform designation signal dCom, a signal for controlling the transport mechanism 7, and the like. While controlling the transport mechanism 7 to change the relative position of the recording sheet P with respect to the head unit HU, the control unit 6 then controls, in accordance with various control signals such as the print signal SI or various data stored in the storage unit 8, the supply circuit 10 such that the discharging unit D is driven. Thereby, the control unit 6 controls respective units of the ink jet printer 1 such that whether or not ink discharging from the discharging unit D is enabled, an amount of ink to discharge, a timing of ink discharging, or the like is adjusted and controls a printing process for forming an image corresponding to the print data Img on the recording sheet P.

Figure 2:
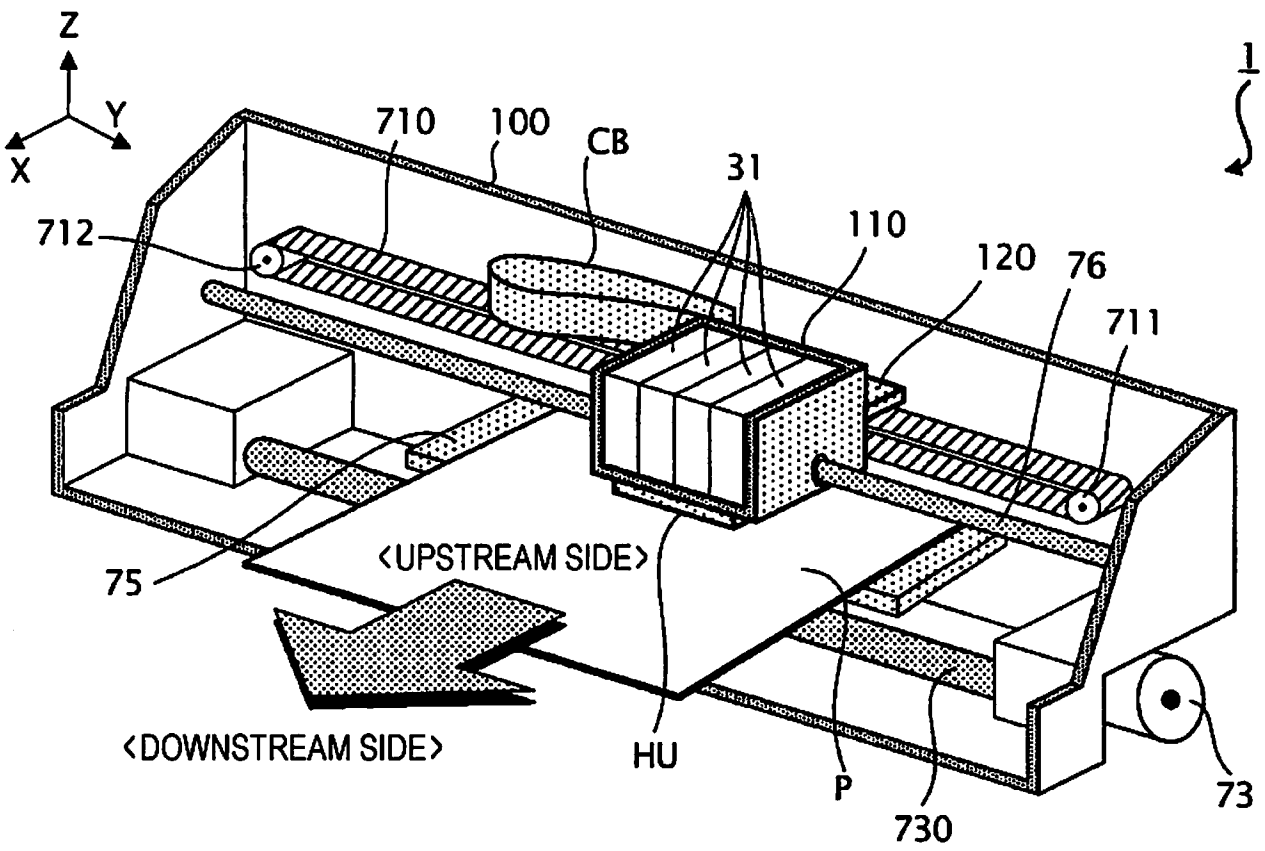
FIG. 2 is a schematic perspective view illustrating an example internal configuration of the ink jet printer.

FIG. 2 is a schematic perspective view illustrating an example of the internal structure of the ink jet printer 1.

As illustrated in FIG. 2, in the present embodiment, a case where the ink jet printer 1 is a serial printer is assumed. Specifically, when performing a printing process, the ink jet printer 1 causes the discharging unit D to discharge ink while transporting the recording sheet P in the secondary scan direction and reciprocating the head unit HU in the primary scan direction orthogonal to the secondary scan direction and thereby forms dots on the recording sheet P in accordance with the print data Img.

In the following description, the +X direction and the −X direction opposite thereto are collectively referred to as the "X-axis direction", the +Y direction and the −Y direction opposite thereto are collectively referred to as the "Y-axis direction", and the +Z direction and the −Z direction opposite thereto are collectively referred to as the "Z-axis direction". In the present embodiment, as illustrated in FIG. 2, a direction from the −X side (upstream side) to the +X side (downstream side) is defined as the secondary scan direction, and the Y-axis direction is defined as the primary scan direction. Note that, although the X-axis direction, the Y-axis direction, and the Z-axis direction are considered to be orthogonal to each other as an example in the present embodiment, the X-axis direction, the Y-axis direction, and the Z-axis direction may be any directions as long as these directions intersect each other.

As illustrated in FIG. 2 as an example, the ink jet printer 1 according to the present embodiment includes a casing 100 and, inside the casing 100, a carriage 110 that can reciprocate in the Y-axis direction and on which the head unit HU is mounted. Note that the casing 100 and a metal member provided inside the casing 100 and fixed to the casing 100 may be denoted as "frame".

Further, as described above, the ink jet printer 1 according to the present embodiment includes the transport mechanism 7.

When a printing process is performed, the transport mechanism 7 causes the carriage 110 to reciprocate in the Y-axis direction and transports the recording sheet P in the +X direction to change the relative position of the recording sheet P with respect to the head unit HU, which enables ink to be placed onto across the entire recording sheet P.

As illustrated in FIG. 1, the transport mechanism 7 includes a transport motor 71 that is a driving source for reciprocating the carriage 110, a motor driver 72 for driving the transport motor 71, a sheet feeding motor 73 that is a driving source for transporting the recording sheet P, and a motor driver 74 for driving the sheet feeding motor 73. Further, as illustrated in FIG. 2, the transport mechanism 7 includes a carriage guide shaft 76 extending in the Y-axis direction and a timing belt 710 extending in the Y-axis direction that is bridged between a pulley 711 rotated and driven by the transport motor 71 and a rotatable pulley 712. The carriage 110 is supported by the carriage guide shaft 76 so as to be able to reciprocate in the Y-axis direction and fixed to a predetermined portion of the timing belt 710 via a fixing tool 120. Thus, the transport mechanism 7 can cause the carriage 110 to reciprocate in the Y-axis direction along the carriage guide shaft 76 together with the head unit HU by causing the transport motor 71 to rotate and drive the pulley 711.

Further, as illustrated in FIG. 2, the transport mechanism 7 includes a platen 75 provided under (on the −Z side of) the carriage 110, a sheet feeding roller (not shown) adapted to rotate in accordance with driving of the sheet feeding motor 73 and supply recording sheets P one by one on the platen 75, a sheet ejecting roller 730 adapted to rotate in accordance with driving of the sheet feeding motor 73 and transport the recording sheet P on the platen 75 to the sheet ejecting port. Thus, as illustrated in FIG. 2, the transport mechanism 7 can transport the recording sheet P from the −X side (upstream side) to the +X side (downstream side) on the platen 75.

In the present embodiment, as illustrated in FIG. 2 as an example, four ink cartridges 31 are mounted in the carriage 110 of the ink jet printer 1. More specifically, a case where four ink cartridges 31 corresponding to four ink colors (CMYK) of cyan, magenta, yellow, and black in a one-to-one manner are mounted in the carriage 110 is considered as an example in the present embodiment.

Further, a case where M discharging units D are divided into four groups corresponding to the four ink cartridges 31 in a one-to-one manner is considered as an example in the present embodiment. Each of the discharging units D is supplied with ink from the ink cartridge 31 corresponding to the group to which the subject discharging unit D belongs. This enables each of the discharging units D to fill the supplied ink therein and discharge the ink from a nozzle N (see FIG. 3). That is, the M discharging units D of the head unit HU can discharge ink of all of the four CMYK colors together. Note that FIG. 2 is a mere example, and the ink cartridges 31 may be provided outside the carriage 110.

2. Recording Head and Discharging Unit

The recording head HD and the discharging unit D provided in the recording head HD will be described with reference to FIG. 3 and FIG. 4.

Figure 3:
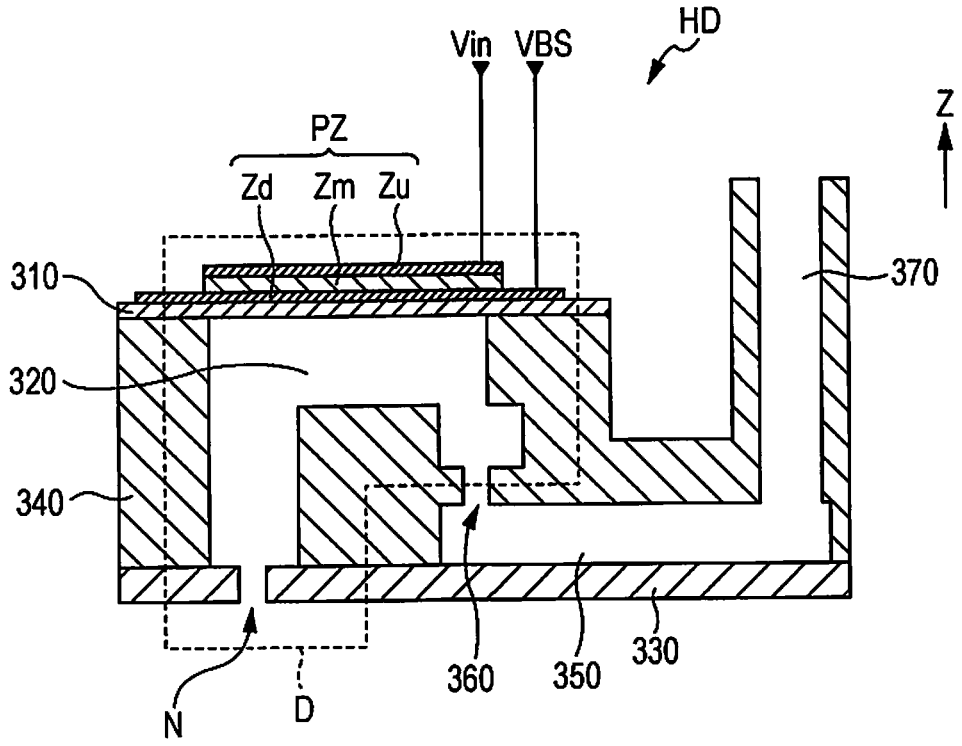
FIG. 3 is a diagram illustrating an example configuration of a discharging unit.

FIG. 3 is a schematic partial sectional view of the recording head HD when the recording head HD is cut so as to include the discharging unit D.

As illustrated in FIG. 3, the discharging unit D includes a piezoelectric element PZ, a cavity 320 into which ink is filled, a nozzle N connected to the cavity 320, and a vibration plate 310. The supply drive signal Vin is supplied to the piezoelectric element PZ, and the piezoelectric element PZ is driven by the supply drive signal Vin, and thereby the discharging unit D discharges ink in the cavity 320 from the nozzle N. The cavity 320 is a space defined by the cavity plate 340, a nozzle plate 330 in which the nozzle N is formed, and the vibration plate 310. The cavity 320 is connected to a reservoir 350 via an ink supply port 360. The reservoir 350 is connected to the ink cartridge 31 corresponding to the subject discharging unit D via an ink intake port 370.

The piezoelectric element PZ in the present embodiment is a unimorph (monomorph) type, as illustrated in FIG. 3. Note that the piezoelectric element PZ is not limited to the unimorph type and may be a bimorph type, a stacked type, or the like.

The piezoelectric element PZ has an upper electrode Zu, a lower electrode Zd, and a piezoelectric member Zm provided between the upper electrode Zu and the lower electrode Zd. The lower electrode Zd is electrically connected to a power supply line LHd (see FIG. 8) set at a lower-side power source potential VBS. Then, once the drive signal Com (the supply drive signal Vin) is supplied to the upper electrode Zu and a voltage is applied between the upper electrode Zu and the lower electrode Zd, the piezoelectric element PZ deforms in the +Z direction or the −Z direction in accordance with the applied voltage, which results in vibration of the piezoelectric element PZ.

The vibration plate 310 is set to the upper surface opening of the cavity plate 340. The lower electrode Zd is joined to the vibration plate 310. Therefore, when the piezoelectric element PZ is deformed by being driven by the supply drive signal Vin, the vibration plate 310 is displaced. The displacement of the vibration plate 310 then causes a change in the volume of the cavity 320, and ink that has been filled into the cavity 320 is discharged from the nozzle N. When ink in the cavity 320 decreases due to being discharged, ink is supplied from the reservoir 350.

Figure 4:
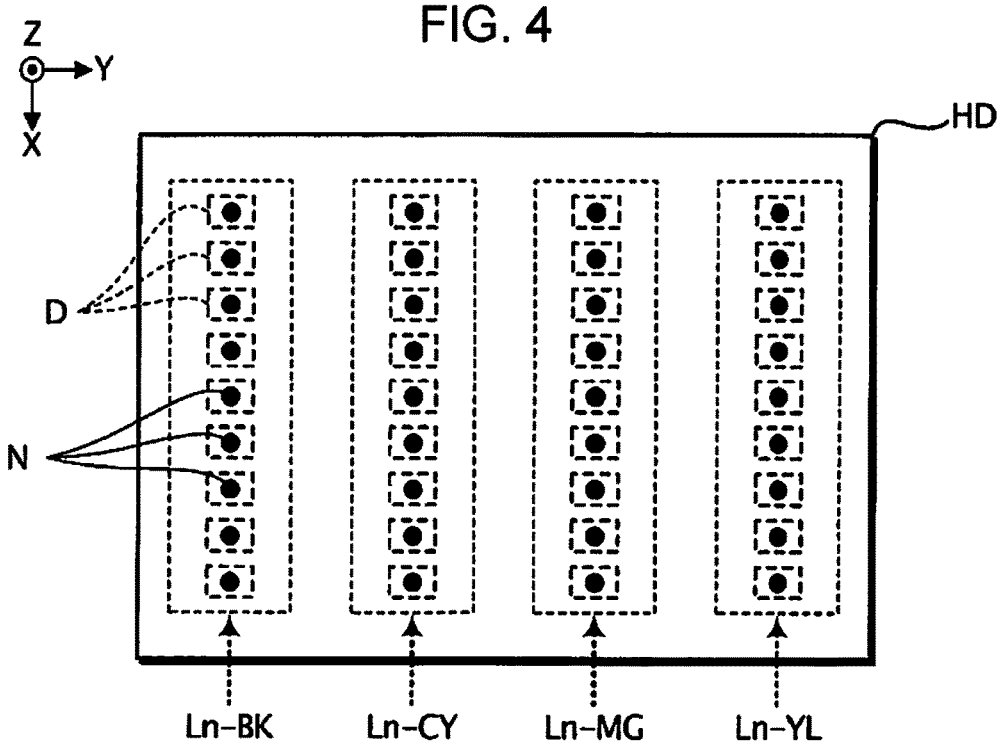
FIG. 4 is a plan view illustrating an example arrangement of nozzles in a recording head.

FIG. 4 is a diagram illustrating an example of the arrangement of M nozzles N provided in the recording head HD in a planar view of the ink jet printer 1 viewed in the +Z direction or the −Z direction.

As illustrated in FIG. 4, four nozzle lines Ln are provided in the recording head HD. The nozzle lines Ln include a plurality of nozzles N provided so as to be aligned in a predetermined direction. In the present embodiment, a case where the nozzle lines Ln are arranged such that the plurality of nozzles N are aligned in the X-axis direction is considered.

In the following description, the four nozzle lines Ln provided in the recording head HD are referred to as nozzle line Ln-BK, nozzle line Ln-CY, nozzle line Ln-MG, and nozzle line Ln-YL. In this example, the nozzle line Ln-BK is one of the nozzle lines Ln in which the nozzles N of the discharging units D which discharge black ink are aligned. The nozzle line Ln-CY is one of the nozzle lines Ln in which the nozzles N of the discharging units D which discharge cyan ink are aligned. The nozzle line Ln-MG is one of the nozzle lines Ln in which the nozzles N of the discharging units D which discharge magenta ink are aligned. The nozzle line Ln-YL is one of the nozzle lines Ln in which the nozzles N of the discharging units D which discharge yellow ink are aligned.

However, the nozzle lines Ln illustrated in FIG. 4 are an example, and the plurality of nozzles N of each nozzle line Ln may be arranged so as to have a predetermined width in a direction intersecting the direction in which the nozzle lines Ln are aligned. That is, for the nozzle lines Ln, the plurality of nozzles N of respective nozzle lines Ln may be arranged in a staggered manner such that the nozzles N which are even-numbered from the +X side and the nozzles N which are odd-numbered from the +X side have a different position in the Y-axis direction. Further, each of the nozzle lines Ln may have a direction different from the X-axis direction. Further, although the case where the number of nozzle lines Ln provided in the recording head HD is four is described in the present embodiment, any number may be used as long as at least one nozzle line Ln is provided.

3. Drive Signal Generation circuit

Next, the drive signal generation circuit 5 will be described with reference to FIG. 5 to FIG. 7.

Figure 5:
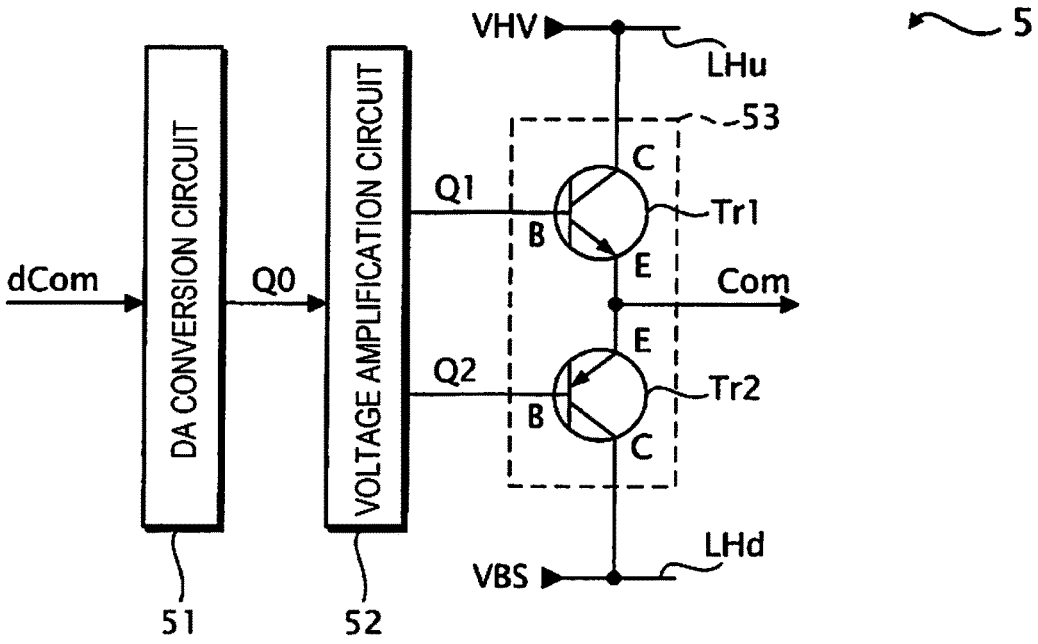
FIG. 5 is a block diagram illustrating an example configuration of the drive signal generation circuit.

FIG. 5 is a block diagram illustrating a configuration of the drive signal generation circuit 5.

As illustrated in FIG. 5, the drive signal generation circuit 5 includes a DA conversion circuit 51, a voltage amplification circuit 52, and a current amplification circuit 53.

The DA conversion circuit 51 outputs a signal Q0 that defines the waveform of the drive signal Com based on the waveform designation signal dCom.

The voltage amplification circuit 52 outputs a signal Q1 and a signal Q2 in accordance with the signal Q0. Specifically, the voltage amplification circuit 52 amplifies a voltage between a reference potential, such as the lower-side power source potential VBS, and the signal Q0 and thereby outputs the signal Q1 and signal Q2 indicating potentials in accordance with the potential of the drive signal Com.

The current amplification circuit 53 is a so-called push-pull circuit including a transistor Tr1 (an example of a first transistor) and a transistor Tr2 (an example of a second transistor).

Specifically, the transistor Tr1 is an NPN-type bipolar transistor, for example. The signal Q1 is supplied to the base (B). The collector (C) is electrically connected to a power supply line LHu that supplies the higher-side power source potential VHV, and the emitter (E) is electrically connected to a wiring LHa that supplies the drive signal Com.

Further, the transistor Tr2 is an NPN-type bipolar transistor, for example. The signal Q2 is supplied to the base (B). The collector (C) is electrically connected to a power supply line LHd that supplies the lower-side power source potential VBS, and the emitter (E) is electrically connected to wiring LHa that supplies the drive signal Com.

The current amplification circuit 53 generates the drive signal Com in accordance with the signal Q1 and the signal Q2. Specifically, the transistor Tr1 of the current amplification circuit 53 is switched on when the potential of the signal Q1 rises, which results in an increase in the potential of the drive signal Com. Note that the transistor Tr1 is switched off when the potential of the signal Q1 is constant or falls.

On the other hand, when the potential of the signal Q2 falls, the transistor Tr2 of the current amplification circuit 53 is switched on, which results in a decrease in the potential of the drive signal Com. Note that the transistor Tr2 is switched off when the potential of the signal Q2 is constant or rises.

Figure 6:
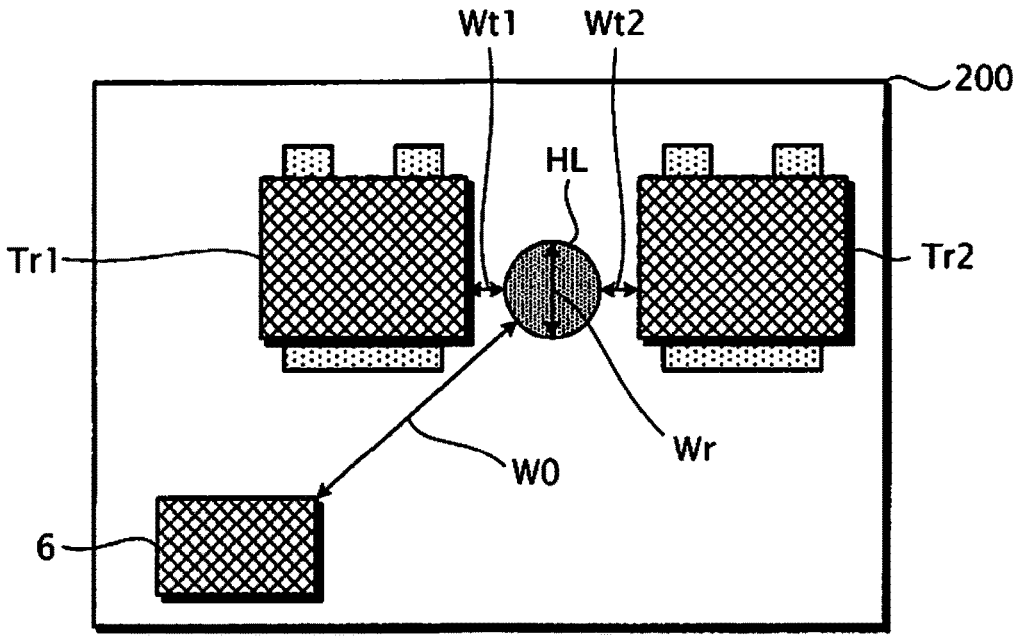
FIG. 6 is a diagram illustrating an example of a circuit arrangement on a substrate.
Figure 7:
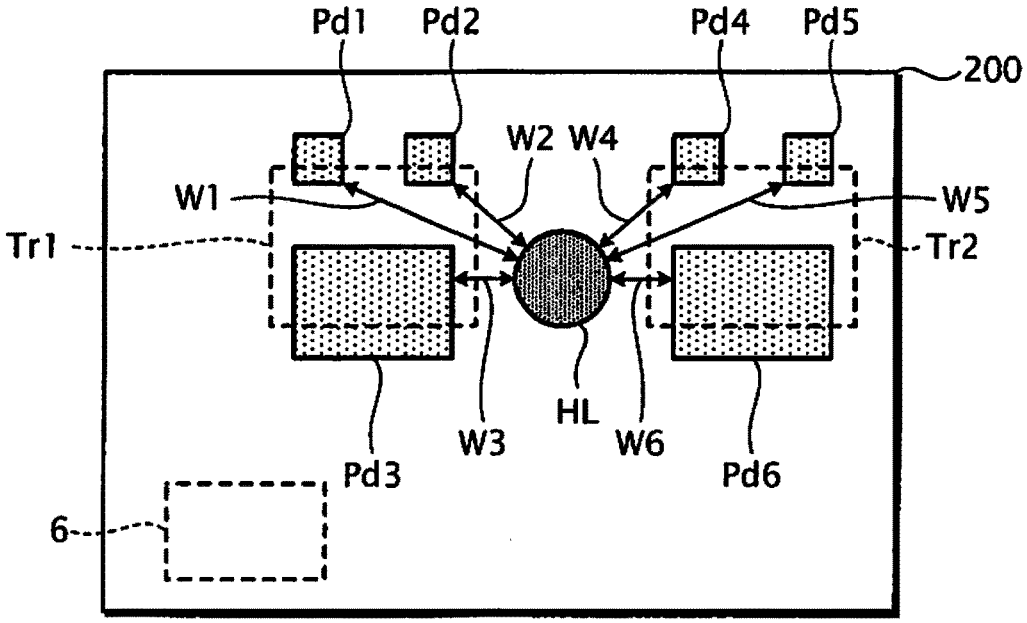
FIG. 7 is a diagram illustrating an example of a wiring pattern on the substrate.

FIG. 6 and FIG. 7 are diagrams illustrating an example of the circuit arrangement of the drive signal generation circuit 5 and the control unit 6. FIG. 6 is a diagram illustrating the arrangement of the control unit 6 and the transistors Tr1 and Tr2 on the substrate 200 of the components of the control module 2. Further, FIG. 7 is a schematic diagram illustrating an example of a wiring pattern on the substrate 200.

As illustrated in FIG. 6, the control unit 6 and the transistors Tr1 and Tr2 of the drive signal generation circuit 5 are arranged on the substrate 200. Further, a screw hole HL in which a screw used for fixing the substrate 200 to the frame of the ink jet printer 1 is to be inserted is formed between the transistors Tr1 and Tr2 on the substrate 200.

Following, the diameter of the screw hole HL is denoted as "Wr", the distance between the screw hole HL and the transistor Tr1 is denoted as "Wt1", the distance between the screw hole HL and the transistor Tr2 is denoted as "Wt2", and the distance between the screw hole HL and the control unit 6 is denoted as "W0". In this case, the diameter Wr, the distance Wt1, the distance Wt2, and the distance W0 satisfy Equation (1) to Equation (5).

$$Wt1<W0 \quad \text{Equation (1)}$$

$$Wt2<W0 \quad \text{Equation (2)}$$

$$Wt1<Wr \quad \text{Equation (3)}$$

$$Wt2<Wr \quad \text{Equation (4)}$$

$$|Wt1-Wt2|\leq\delta \quad \text{Equation (5)}$$

The distance δ appearing in Equation (5) is a predetermined distance, for example, 0.1 millimeters. Note that, although the components on the substrate 200 are arranged to satisfy Equation (1) to Equation (5) in the present embodiment, the invention is not limited to such an arrangement. The components on the substrate 200 are arranged to satisfy at least Equation (1) and Equation (2), and more preferably arranged to satisfy at least Equation (1) to Equation (4).

As illustrated in FIG. 7, the substrate 200 is provided with an emitter electrode pad Pd1 (an example of a first pad) connected to a lead electrically connected to the emitter of the transistor Tr1, a base electrode pad Pd2 (an example of a second pad) connected to a lead electrically connected to the base of the transistor Tr1, a collector electrode pad Pd3 (an example of a third pad) connected to a lead electrically connected to the collector of the transistor Tr1, an emitter electrode pad Pd4 (an example of a fourth pad) connected to a lead electrically connected to the emitter of the transistor Tr2, a base electrode pad Pd5 (an example of a fifth pad) connected to a lead electrically connected to the base of the transistor Tr2, and a collector electrode pad Pd6 (an example of a sixth pad) connected to a lead electrically connected to the collector of the transistor Tr2.

In the following, the distance between the emitter electrode pad Pd1 and the screw hole HL is denoted as "W1", the distance between the base electrode pad Pd2 and the screw hole HL is denoted as "W2", the distance between the collector electrode pad Pd3 and the screw hole HL is denoted as "W3", the distance between the emitter electrode pad Pd4 and the screw hole HL is denoted as "W4", the distance between the base electrode pad Pd5 and the screw hole HL is denoted as "W5", and the distance between the collector electrode pad Pd6 and the screw hole HL is denoted as "W6". In this case, the distances W1 to W6 satisfy Equation (6) to Equation (15).

$$W3<W1 \quad \text{Equation (6)}$$

$$W3<W2 \quad \text{Equation (7)}$$

$$W6<W4 \quad \text{Equation (8)}$$

$$W6<W5 \quad \text{Equation (9)}$$

$$W3<W0 \quad \text{Equation (10)}$$

$$W6<W0 \quad \text{Equation (11)}$$

$$W3<Wr \quad \text{Equation (12)}$$

$$W6<Wr \quad \text{Equation (13)}$$

$$W2<W1 \quad \text{Equation (14)}$$

$$W4<W5 \quad \text{Equation (15)}$$

Note that, although the components on the substrate 200 are arranged to satisfy Equation (6) to Equation (15) in the present embodiment, the invention is not limited to such an arrangement. The components on the substrate 200 are arranged to satisfy at least Equation (6) and Equation (9), and more preferably arranged to satisfy at least Equation (6) to Equation (13).

4. Configuration of Head Unit

The configuration of the head unit HU will be described below with reference to FIG. 8.

Figure 8:
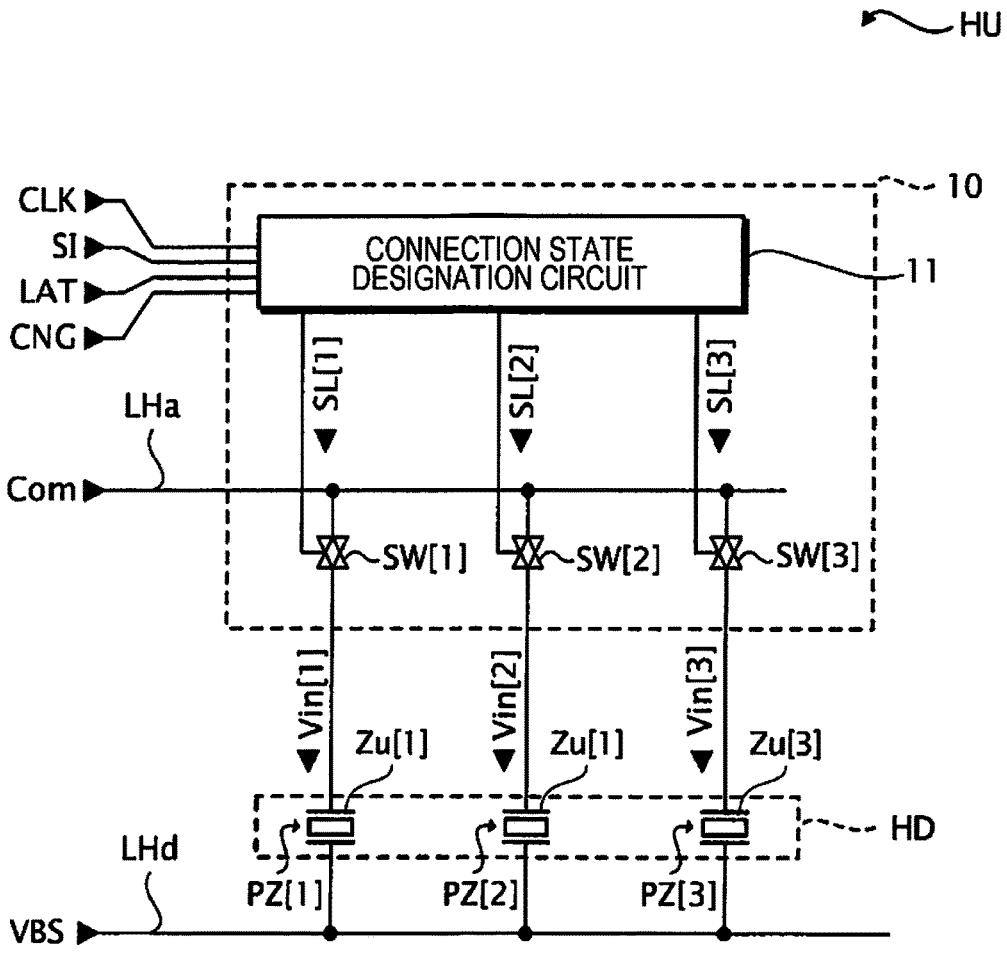
FIG. 8 is a block diagram illustrating an example of a wiring pattern on the substrate.

FIG. 8 is a block diagram illustrating an example of the configuration of the head unit HU. As described above, the head unit HU includes the recording head HD, the supply circuit 10, the wiring LHa supplied with the drive signal Com from the drive signal generation circuit 5, and the power supply line LHd.

The supply circuit 10 includes M switches SW (SE(1) to SW(M)) and a connection state designation circuit 11 that designates the connection state of each of the switches SW. Note that a transmission gate may be employed to each of the switches SW, for example. Note that FIG. 8 illustrates a case of M=3 for simplified illustration.

The connection state designation circuit 11 generates connection state designation signals SL(1) to SL(M) that designate switching on or off of the switches SW(1) to SW(M) in accordance with at least some of a clock signal CLK, a print signal SI, a latch signal LAT, and a change signal CNG supplied from the control unit 6.

The switch SW(m) switches a connection state to/from the non-connection state between the wiring LHa and the upper electrode Zu(m) of the piezoelectric element PZ(m) provided in the discharging unit D(m) in accordance with the connection state designation signal SL(m). For example, the switch SW(m) is switched on when the connection state designation signal SL(m) is a high level and switched off when the connection state designation signal SL(m) is a low level. As described above, in the drive signal Com, a signal actually supplied to the piezoelectric element PZ(m) of the discharging unit D(m) via the switch SW(m) is the supply drive signal Vin(m).

5. Operation of Head Unit

The operation of the head unit HU will be described below with reference to FIG. 9 to FIG. 11.

In the present embodiment, an operation period of the ink jet printer 1 includes one or more unit periods Tu. The ink jet printer 1 can drive respective discharging units D for performing a printing process. The ink jet printer 1 then performs a printing process in a plurality of unit periods Tu provided in a continuous manner or an intermittent manner and causes each discharging unit D to discharge ink once or multiple times to form an image indicated by the print data Img.

Figure 9:
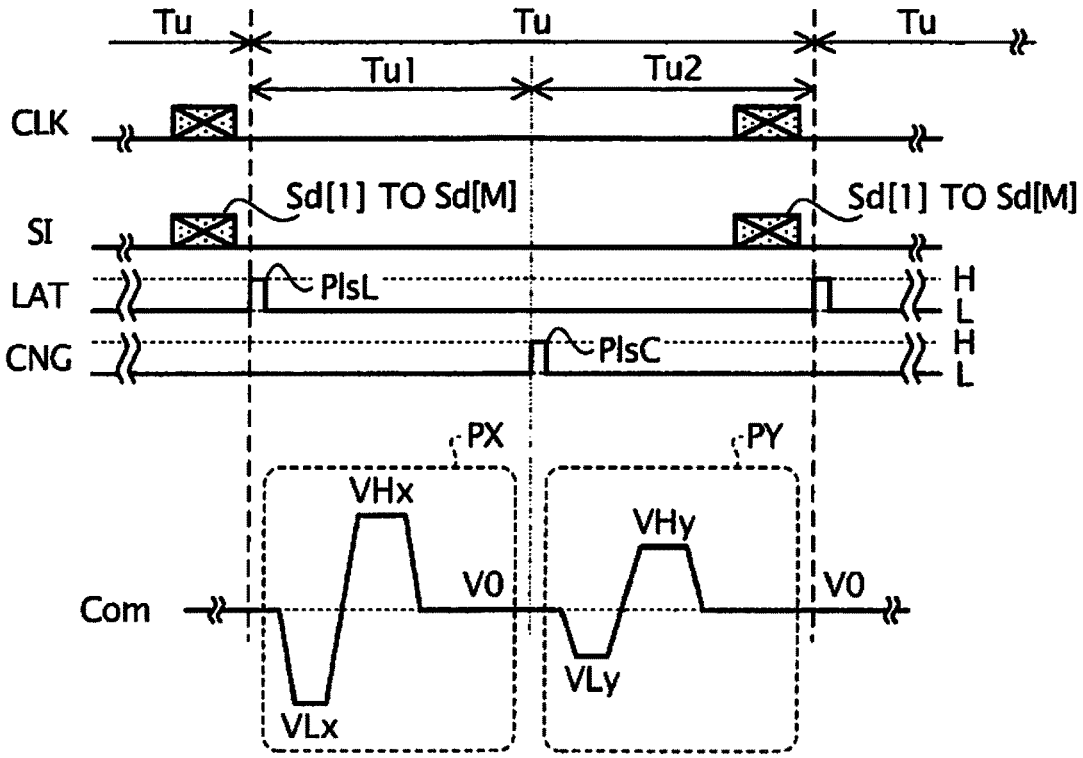
FIG. 9 is a timing chart illustrating an example of an operation in a printing process.

FIG. 9 is a timing chart illustrating an example of the operation of the ink jet printer 1 in the unit period Tu.

As illustrated in FIG. 9, the control unit 6 outputs the latch signal LAT having a pulse PlsL. Thereby, the control unit 6 defines the unit period Tu by a period from the rising edge of the pulse PlsL to the rising edge of the next pulse PlsL. Further, the control unit 6 outputs a change signal CNG having a pulse PlsC. Thereby, the control unit 6 divides the unit period Tu into a control period Tu1 from the rising edge of the pulse PlsL to the rising edge of the pulse PlsC and a control period Tu2 from the rising edge of the pulse PlsC to the rising edge of the next pulse PlsL.

Further, the print signal SI includes individual designation signals Sd(1) to Sd(m) designating a type of operation of each of the discharging units D(1) to D(m) in each unit period Tu. When a printing process is performed in the unit period Tu, the control unit 6 supplies the print signal SI including the individual designation signals Sd(1) to Sd(m) to the connection state designation circuit 11 in synchronization with the clock signal CLK prior to the present unit period Tu. In this case, the connection state designation circuit 11 generates the connection state designation signal SL(m) in accordance with the individual designation signal Sd(m) in the present unit period Tu.

As illustrated in FIG. 9, the drive signal Com has a waveform PX provided in the control period Tu1 and a waveform PY provided in the control period Tu2. In the present embodiment, the waveform PX and the waveform PY are defined such that the difference between the highest potential VHX and the lowest potential VLX of the waveform PX is greater than the difference between the highest potential VHY and the lowest potential VLY of the waveform PY. Specifically, when the discharging unit D(m) is driven by the drive signal Com having the waveform PX, the waveform PX is defined such that an amount of ink corresponding to a middle dot (a middle level amount) is discharged from the discharging unit D(m). Further, when the discharging unit D(m) is driven by the drive signal Com having the waveform PY, the waveform PY is defined such that an amount of ink corresponding to a smaller dot (a smaller level amount) is discharged from the discharging unit D(m). Note that each of the waveform PX and the waveform PY is set such that the potential at the start time and the end time is the reference potential V0.

Figures 10, 11:
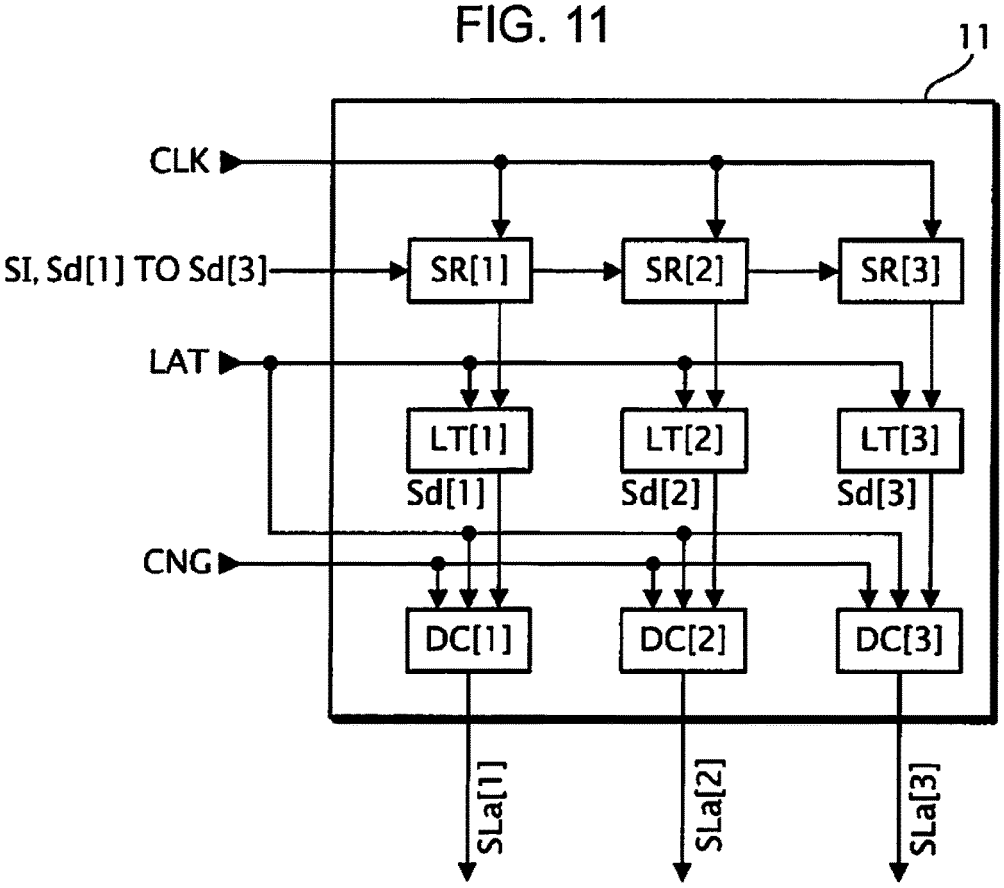
FIG. 10 is a diagram illustrating an example of a connection state designation signal.
FIG. 11 is a block diagram illustrating an example configuration of a connection state designation circuit.

FIG. 10 is a diagram illustrating the relationship between the individual designation signal Sd(m) and the connection state designation signal SL(m).

As illustrated in FIG. 10, a case where the individual designation signal Sd(m) is a two-bit digital signal is considered in the present embodiment. Specifically, for the discharging unit D(m), the individual designation signal Sd(m) is set to any one of the following four values in each unit period Tu: a value (1, 1) that designates discharging of an amount of ink corresponding to a larger dot (a larger level amount) (referred to as larger dot formation), a value (1, 0) that designates discharging of an amount of ink corresponding to a middle dot (a middle level amount) (referred to as middle dot formation), a value (0, 1) that designates discharging of an amount of ink corresponding to a smaller dot (a smaller level amount) (referred to as smaller dot formation), and a value (0, 0) that designates no discharging.

When the individual designation signal Sd(m) is set to the value (1, 1) designating larger dot formation, the connection state designation circuit 11 sets the connection state designation signal SL(m) to a high level in the control periods Tu1 and Tu2. In this case, the discharging unit D(m) is driven by the drive signal Com of the waveform PX in the control period Tu1 to discharge a middle amount of ink and is driven by the drive signal Com of the waveform PY in the control period Tu2 to discharge a smaller amount of ink. This causes the discharging unit D(m) to discharge a larger amount of ink in total during the unit period Tu, and a larger dot is formed on the recording sheet P.

When the individual designation signal Sd(m) is set to the value (1, 0) designating a middle dot formation, the connection state designation circuit 11 sets the connection state designation signal SL(m) to a high level in the control period Tu1 and a low level in the control period Tu2, respectively. In this case, the discharging unit D(m) discharges a middle amount of ink in the unit period Tu, and a middle dot is formed on the recording sheet P.

When the individual designation signal Sd(m) is set to the value (0, 1) designating a smaller dot formation, the connection state designation circuit 11 sets the connection state designation signal SL(m) to a low level in the control period Tu1 and a high level in the control period Tu2, respectively. In this case, the discharging unit D(m) discharges a smaller amount of ink in the unit period Tu, and a middle dot is formed on the recording sheet P.

When the individual designation signal Sd(m) is set to the value (0, 0) designating no discharging of ink, the connection state designation circuit 11 sets the connection state designation signal SL(m) to a low level in the control periods Tut and Tu2. In this case, the discharging unit D(m) discharges no ink in the unit period Tu, and no dot is formed on the recording sheet P.

FIG. 11 is a diagram illustrating an example configuration of the connection state designation circuit 11 according to the present embodiment. As illustrated in FIG. 11, the connection state designation circuit 11 generates the connection state designation signals SL(1) to SL(m).

Specifically, the connection state designation circuit 11 has transfer circuits SR(1) to SR(m), latch circuits LT(1) to LT(m), and decoders DC(1) to DC(m), all of which correspond to the discharging units D(1) to D(m) in a one-to-one manner. The individual designation signal Sd(m) is supplied to the transfer circuit SR(m). Note that FIG. 11 illustrates a case where the individual designation signals Sd(1) to Sd(m) are supplied in serial and, for example, the individual designation signal Sd(m) corresponding to m-th stage is transferred in synchronization with the clock signal CLK from the transfer circuit SR(1) to the transfer circuit SR(m). Further, the latch circuit LT(m) latches the individual designation signal Sd(m) supplied to the transfer circuit SR(m) at a timing when the pulse PlsL of the latch signal LAT rises to a high level. Further, the decoder DC(m) generates the connection state designation signal SL(m) according to FIG. 10 in accordance with the individual designation signal Sd(m), the latch signal LAT, and the change signal CNG.

6. Conclusion of Embodiment

In general, the drive signal Com used for driving the discharging unit D is a signal having a large amplitude, and the drive signal generation circuit 5 generates heat when generating the drive signal Com. In particular, in the drive signal generation circuit 5, the transistors Tr1 and Tr2 that output the drive signal Com generate large heat. That is, in the drive signal generation circuit 5, the temperatures of the transistors Tr1 and Tr2 are likely to be higher than other components formed on the substrate 200.

To address this, in the present embodiment, the screw hole HL in which a screw used for fixing the substrate 200 to the frame is to be inserted is provided between the transistors Tr1 and Tr2. Thus, in the present embodiment, heat generated by the transistors Tr1 and Tr2 can be dissipated to the frame via the screw hole HL and a screw inserted in the screw hole HL. Therefore, compared to a case of no screw hole HL being provided between the transistors Tr1 and Tr2, the present embodiment can suppress the temperature of the drive signal generation circuit 5 to a low temperature and reduce the likelihood of occurrence of a malfunction due to a rise in the temperature of the drive signal generation circuit 5.

Further, in general, heat generated by a collector is greater than heat generated by an emitter and a base in a transistor.

In view of this, in the present embodiment, the screw hole HL is provided to a position which is located between the collector electrode pad Pd3 electrically connected to the collector of the transistor Tr1 and the collector electrode pad Pd6 electrically connected to the collector of the transistor Tr2 and which meets Equation (6) to Equation (9). Therefore, in the embodiment, heat generated by the transistors Tr1 and Tr2 can be effectively dissipated to the frame via the screw hole HL and a screw inserted in the screw hole HL.

Further, in the present embodiment, as is apparent from Equation (1), Equation (2), Equation (10), Equation (11), and the like, the screw hole HL is provided to a position closer to the transistors Tr1 and Tr2 than to the control unit 6. Therefore, in the present embodiment, heat generated by the transistors Tr1 and Tr2 can be effectively dissipated compared to a case of the screw hole HL being provided to a position closer to the control unit 6 than to the transistors Tr1 and Tr2, which can prevent the heat generated by the transistors Tr1 and Tr2 from transmitting to the control unit 6.

Further, in the present embodiment, as is apparent from Equation (3), Equation (4), Equation (12), Equation (13), and the like, the diameter Wr of the screw hole HL is larger than the distance W3 between the screw hole HL and the collector electrode pad Pd3 and the distance W6 between the screw hole HL and the collector electrode pad Pd6. Therefore, heat generated by the transistor Tr1 and Tr2 can be effectively dissipated compared to a case of the diameter Wr of the screw hole HL being smaller than the distance W3 and the distance W6.

B. Modified Examples

The above embodiment can be modified in various ways. Specific modified examples will be described below. Any two or more examples selected from the following examples may be combined appropriately unless the examples to be combined are discrepant to each other. Note that, in the modified examples described below, elements whose effect and function are the same as those in the embodiment are labeled with the reference symbol used in the above description, and the detailed description of each element will be omitted.

First Modified Example

Although a single screw hole HL is provided between the transistors Tr1 and Tr2 in the embodiment described above, the invention is not limited to such an arrangement, but a plurality of screw holes HL may be provided between the transistors Tr1 and Tr2.

Figure 12:
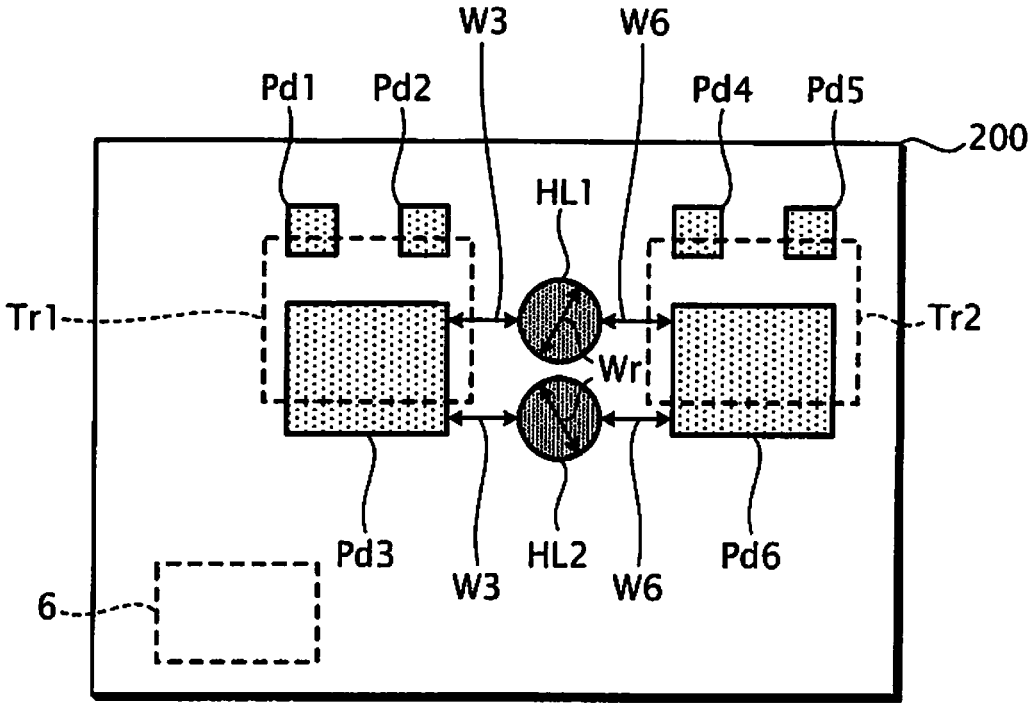
FIG. 12 is a diagram illustrating an example of a wiring pattern on a substrate in a first modified example.

FIG. 12 is a diagram illustrating an example of the wiring pattern on the substrate 200 of the ink jet printer 1 according to the present modified example. As illustrated in FIG. 12, in the present modified example, the substrate 200 has two screw holes HL1 and HL2 between the transistors Tr1 and Tr2. Each of the screw holes HL1 and HL2 is provided so as to satisfy at least Equation (1), Equation (2), and Equation (6) to Equation (9) described above, preferably satisfy Equation (1) to Equation (4) and Equation (6) to Equation (13) described above, and more preferably satisfy all Equation (1) to Equation (15) described above.

According to this modified example, since a plurality of screw holes HL are provided between the transistors Tr1 and Tr2, heat generated by the transistors Tr1 and Tr2 can be effectively dissipated.

Second Modified Example

Although the ink jet printer 1 includes the single drive signal generation circuit 5 and the single head unit HU in the embodiment and the modified example described above, the invention is not limited to such an arrangement, but the ink jet printer 1 may include a plurality of drive signal generation circuits 5 or may include a plurality of head units HU.

For example, the ink jet printer 1 may selectively supply a plurality of drive signals Com having waveforms different from each other to each discharging unit D of the head unit HU to drive the subject discharging unit D. In this case, a plurality of drive signal generation circuit 5 may be provided on the substrate 200 so as to correspond to the plurality of drive signals Com in a one-to-one manner.

Further, for example, the ink jet printer 1 may include a plurality of head units HU. In this case, a plurality of drive signal generation circuit 5 may be provided on the substrate 200 so as to correspond to the plurality of head units HU in a one-to-one manner.

Further, in the present modified example, when a plurality of drive signal generation circuits 5 are provided on the substrate 200, it is preferable that one or more screw holes HL be provided between the transistors Tr1 and Tr2 of each of the drive signal generation circuits 5.

Third Modified Example

Although a case where the ink jet printer 1 is a serial printer is considered in the embodiment and the modified examples described above, the invention is not limited to such an implementation, but the ink jet printer 1 may be a so-called line printer in which a plurality of nozzles N are provided in the recording head HD so as to extend wider than the width of the recording sheet P.

What is claimed is:

1. A liquid discharging apparatus comprising:

a head unit driven by a drive signal to discharge a liquid;

a substrate; and a first transistor and a second transistor provided on the substrate and configured to generate the drive signal, wherein, in the substrate, a screw hole is provided between the first transistor and the second transistor, wherein the substrate is fixed to a frame of the liquid discharging apparatus by a screw inserted into the screw hole, and wherein a diameter of the screw hole is larger than distances between the screw hole and the first and second transistors.

2. The liquid discharging apparatus according to claim 1, wherein a first pad electrically connected to an emitter of the first transistor, a second pad electrically connected to a base of the first transistor, and a third pad electrically connected to a collector of the first transistor are provided on the substrate, wherein a distance between the screw hole and the first pad is longer than a distance between the screw hole and the third pad, and wherein a distance between the screw hole and the second pad is longer than the distance between the screw hole and the third pad.

3. The liquid discharging apparatus according to claim 2, further comprising a waveform designation circuit provided on the substrate and configured to generate a waveform designation signal designating a waveform of the drive signal, wherein the first transistor and the second transistor generate the drive signal having a waveform designated by the waveform designation signal, and wherein a distance between the screw hole and the waveform designation circuit is longer than the distance between the screw hole and the third pad.

4. The liquid discharging apparatus according to claim 2, wherein the diameter of the screw hole is larger than the distance between the screw hole and the third pad.

5. The liquid discharging apparatus according to claim 1, wherein a first pad electrically connected to an emitter of the second transistor, a second pad electrically connected to a base of the second transistor, and a third pad electrically connected to a collector of the second transistor are provided on the substrate, wherein a distance between the screw hole and the first pad is longer than a distance between the screw hole and the third pad, and wherein a distance between the screw hole and the second pad is longer than the distance between the screw hole and the third pad.

6. The liquid discharging apparatus according to claim 5, further comprising a waveform designation circuit provided on the substrate and configured to generate a waveform designation signal designating a waveform of the drive signal, wherein the first transistor and the second transistor generate the drive signal having a waveform designated by the waveform designation signal, and wherein a distance between the screw hole and the waveform designation circuit is longer than the distance between the screw hole and the third pad.

7. The liquid discharging apparatus according to claim 5, wherein the diameter of the screw hole is larger than the distance between the screw hole and the third pad.

8. A liquid discharging apparatus comprising:

a head unit driven by a drive signal to discharge a liquid;

a substrate; and a first transistor and a second transistor provided on the substrate and configured to generate the drive signal, wherein, in the substrate, a plurality of screw holes are provided between the first transistor and the second transistor, wherein the substrate is fixed to a frame of the liquid discharging apparatus by a plurality of screws inserted into the screw holes, respectively, and wherein a diameter of the screw holes is larger than distances between the screw hole and the first and second transistors.

* * * * *